US005295887A

United States Patent [19]

Zdanowski

[11] Patent Number: 5,295,887

[45] Date of Patent: Mar. 22, 1994

[54] K-G1 ELECTRODE SPACING SYSTEM FOR A CRT ELECTRON GUN

[75] Inventor: Chester L. Zdanowski, Westmont, Ill.

[73] Assignee: Zenith Electronics Corporation, Glenview, Ill.

[21] Appl. No.: 78,939

[22] Filed: Jun. 16, 1993

[51] Int. Cl.[5] ..... H01J 9/18; H01J 9/42

[52] U.S. Cl. ..... 445/63; 445/67

[58] Field of Search ..... 445/63, 67, 3, 34

[56] References Cited

U.S. PATENT DOCUMENTS

| | | | |
|---|---|---|---|
| 2,872,609 | 2/1959 | Wheeler | 313/256 |
| 3,533,147 | 10/1970 | Baur et al. | 29/25.16 |
| 3,667,824 | 6/1972 | Tsuneta et al. | 316/23 |
| 3,848,301 | 11/1974 | Gruber | 29/25.16 |
| 4,846,748 | 7/1989 | Cote | 445/63 |
| 4,850,920 | 7/1989 | Cote | 445/63 |
| 4,898,559 | 2/1990 | Cote | 445/67 |

*Primary Examiner*—Paula A. Bradley
*Assistant Examiner*—Jeffrey T. Knapp
*Attorney, Agent, or Firm*—Roland W. Norris

[57] ABSTRACT

A K-G1 spacing apparatus provides for spacing the dispenser cathode of a CRT electron gun a desired distance from an adjacent apertured grid electrode known as "G1." A probe has an outer shaft with a shoulder for registering with the G1 electrode. The probe includes an inner shaft having a tip on one end for contacting the face of the cathode, and at the opposite end, a linear velocity differential transformer (LVDT). When the cathode contacts the tip of the probe, the LVDT produces an electrical signal which is indicated on a calibrated column, and which denotes the location of the cathode face relative to the G1 electrode. When the desired K-G1 spacing has been attained, the cathode is fixed in permanent relationship with the G1 electrode.

20 Claims, 3 Drawing Sheets

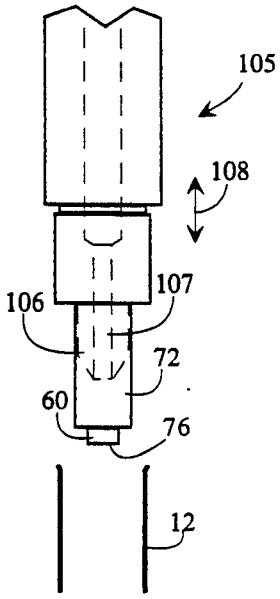
Fig. 6
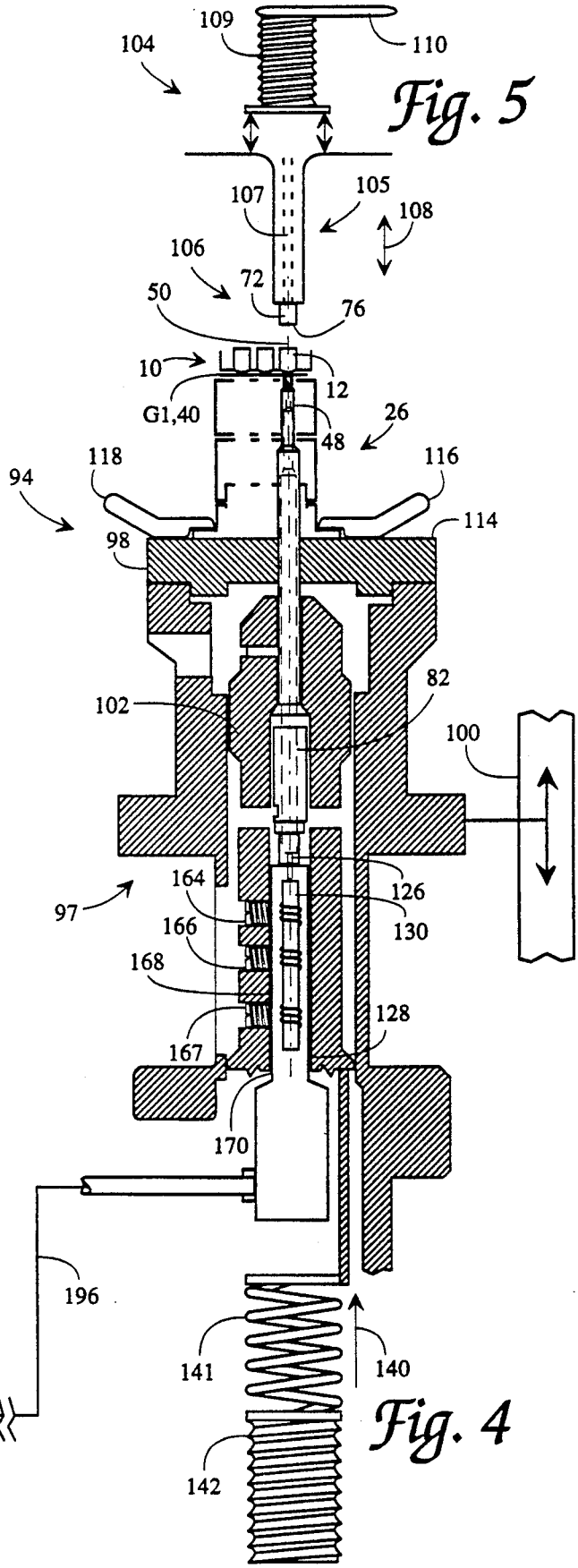
Fig. 5
Fig. 4
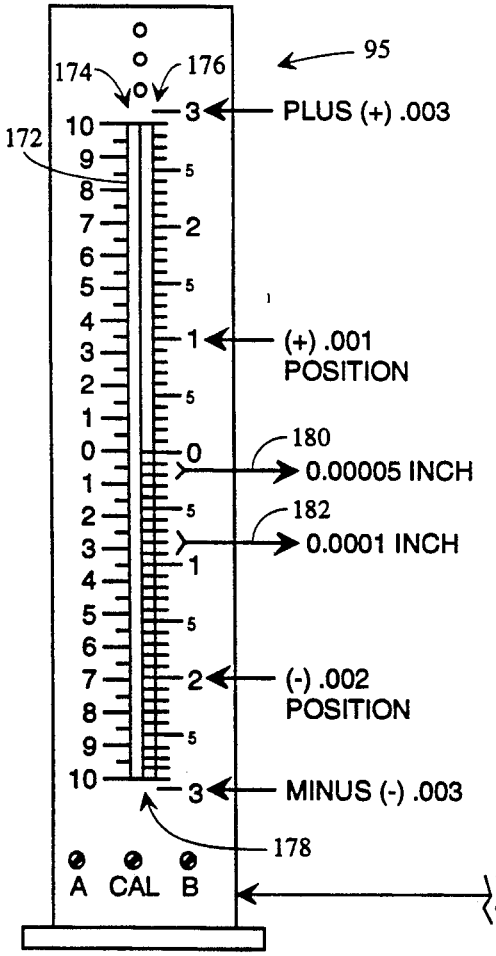
Fig. 7

K-G1 ELECTRODE SPACING SYSTEM FOR A CRT ELECTRON GUN

BACKGROUND OF THE INVENTION

1. Field of the Invention

This invention relates to color cathode ray picture tubes (CRTs), and is addressed specifically to an improved means for gaging the distance between the emitting surface of a cathode (K) and the facing surface of an adjacent electrode, commonly known as "G1", in the electron gun of a CRT. The distance between the cathode and G1 electrode is commonly known as the "K-G1 spacing." The function of the G1 electrode is to draw and form the electron beam from the electrons emitted from the cathode, and to control the intensity of the beam.

2. Discussion of the Related Art

A system for gaging and establishing cathode to grid spacing in electron tubes is disclosed in U.S. Pat. No. 2,872,609 to Wheeler. A spacer such as a Mylar shim is inserted between the cathode and the adjacent grid electrode, and is removed after the cathode is fixed in position. Another type of K-G1 gaging system known in the art relies upon the measurement of the capacitance between the cathode and the G1 electrode, with the K- G1 spacing being a function of the amount of capacitance. A system for the direct gaging of K-G1 spacing is disclosed in U.S. Pat. No. 3,848,301 to Gruber. The basis for measurement is the height of the stack of the electrodes comprising the electron gun. The accuracy of the system is vitiated by the inevitable variances in the heights of the stacks of the guns being gaged, a variance that results from cumulative errors in the stacking process.

K-G1 spacing can be measured by an optical system, in which a light beam is projected through the K-G1 area. As described in U.S. Pat. No. 3,667,824 to Tsuneta et al, the light is optically magnified to provide an image of the K-G1 space, with the dimensions of the image being a function of the distance between the electrodes.

Yet another method for establishing K-G1 spacing is by air gaging, as disclosed in U.S. Pat. No. 3,533,147 to Bauer et al. A jet of air is directed into one end of a transparent, calibrated tubular column. An outlet at the opposite end of the column leads to a tubular probe which extends through the aperture of the adjacent grid electrode. Air passing from the probe encounters the surface of the cathode, and the resulting back pressure is measured by means of a float in the calibrated column. The measurement is thus a function of the amount of resistance to the air flow against the cathode surface, as measured in relation to the G1 (or a G2) electrode. The system can measure K-G1 spacing with an accuracy of ±0.0002 inch. When the desired K-G1 spacing is attained, the cathode is fixed in place relative the G1 electrode by crimping and welding it to a cathode-supporting structure.

The air gaging system is well suited to gaging K-G1 spacing in guns having oxide-coated cathodes as no physical contact is made with the delicate oxide coating. Air gaging however is not practical in electron guns in which the G1 aperture diameter is smaller than 0.016 inch. The walls of an an air-jet probe capable of passing through a smaller aperture must made so thin that the probe becomes too fragile for practical use under manufacturing conditions. Also, as the probe orifice becomes necessarily smaller, the linearity, and hence the sensitivity of the measurement, is adversely affected.

In a gun having multiple beam channels to form and project multiple beams, the K-G1 spacing must be the same for the K-G1 interface in each beam channel. Otherwise, it will be difficult to "track" the three beams; that is, establish a common electrical K-G1 bias. A common negative bias is required to make the electron beams responsive to the dynamic picture signal operating each beam in conjunction with the common voltages of the electron gun which forms the beams. Otherwise, and by way of example, if the K-G1 spacing differs beyond tolerance among the beams, the picture signal may not sufficiently "cut off" a beam when it is not needed, thus degrading the picture.

Two types of electron-emitting cathodes are in common use in electron guns. One is the oxide-coated cathode which is essentially a metal cup covered with an electron-emitting oxide. A cathode of this type and its manufacture is described in commonly owned U.S. Pat. No. 4,619,168 to Wichman. The oxide-coated cathode is susceptible to damage, as the oxide can flake off under mechanical contact. Also, the number of electrons that can be drawn off from an oxide coating is limited.

The other type of cathode in common use is the dispenser cathode, which essentially comprises a round pellet of molybdenum impregnated with barium oxide. The pellet, which is very hard, is enclosed in a tungsten cup with an aperture pattern in its center for the release of the electrons which form the beam. The dispenser cathode is relatively immune from damage by physical contact.

Both types of cathode are caused to emit electrons by heating them to a high temperature by means of a filament enclosed in the cathode structure. The dispenser cathode can be heated to a higher temperature than the oxide-coated cathode, and hence will emit a greater number of electrons.

Because of its greater electron emission and longer life, the dispenser cathode is particularly favored in high resolution CRTs which require a smaller beam spot on the screen. To achieve this smaller spot size the beam needs a higher current density and hence, a smaller G1 aperture to form a more powerful focusing field for the beam. However, because of the smaller G1 spacing aperture, accurate gaging of the K-G1 spacing is made problematic.

BENEFITS OF THE PRESENT INVENTION OVER THE RELATED ART

The ability to measure through a reduced aperture diameter is a salient advantage for high resolution guns. As discussed above, the diameter of a "beam spot" that impinges on the phosphor screen of the CRT is, in a measure, a function of G1 aperture size. A smaller beam spot means a corresponding increase in the resolution of the CRT. Also, if the G1 apertures can be made smaller, the electron gun can be made shorter and more compact, with a consequent reduction in the diameter of the neck, and the length of the CRT envelope. The system according to the present invention can be used for gaging K-G1 spacing where the G1 aperture diameter is as small as 0.005 inch.

The K-G1 spacing system according to the invention can measure electrode spacing with an accuracy and reproducibility exceeding that of the air jet system, and far exceeding that of the other spacing systems described.

OBJECTS OF THE INVENTION

It is among the objects of the invention to:

(a) improve the general performance of CRT electron guns;

(b) provide a system capable of measuring K-G1 spacing in electron guns having a G1 aperture diameter of less than 0.016 inch;

(c) provide a system for measuring K-G1 spacing that is not affected by dimensional variations of the in-process electron gun structure;

(d) provide a system for measuring K-G1 spacing that makes possible the continual monitoring of the spacing during the spacing process;

(e) provide a system for measuring K-G1 spacing that is rugged and well-adapted to the manufacturing environment.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

FIG. 4 is a cross-sectional view of the probe section of the machine according to the present invention.

FIG. 5 is a view similar to the view of FIG. 4 showing a cathode holding component of the machine depicted in FIG. 4.

FIG. 6 is an enlarged, detail view in elevation of the cathode holding component.

FIG. 7 is an enlarged view of the calibrated indicator operator interface.

DESCRIPTION OF THE PREFERRED EMBODIMENT

General Description

The present invention is a cathode spacing system described as being applied to the in-process structure of a four-grid, in-line electron gun. The configuration shown is not a finished electron gun, but one in a stage of production known as a "beaded assembly"; that is, an assembly that is ready for the installation and spacing of the cathodes with respect to an adjacent electrode. The term "beaded" applies to the glass beads 28 that hold the grids, or electrodes, of the gun together, as will be described.

Figure 1:
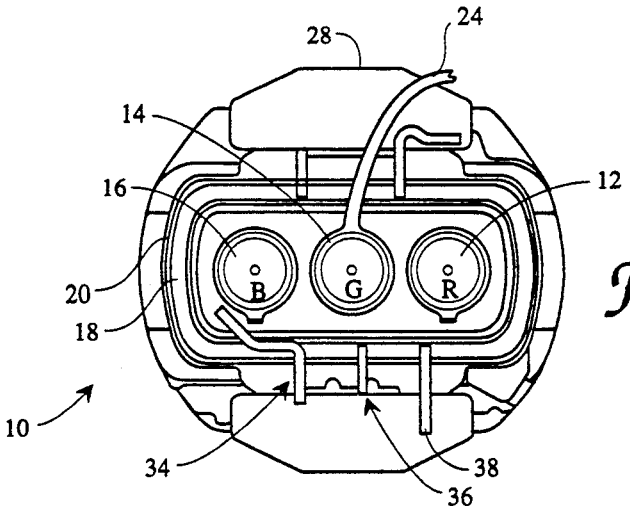
FIG. 1 is a lower end elevation view of a three-beam, in-line electron gun beaded assembly looking through a cathode mounting assembly into the G1 electrode apertures.

FIG. 1 is a depiction of the cathode assembly 10 of a three-beam electron gun as seen from the lower, or cathode, end of the gun. The cathode assembly 10 comprises three tube-like eyelets 12, 14 and 16 for receiving three dispenser cathodes (not shown in this view) which generate the three beams that produce red, green and blue colors when they impinge on designated light-emitting phosphors on the screen (not depicted) of the cathode ray tube. The eyelets 12, 14 and 16 are clinched into an electrically non-conductive ceramic plate 18 which electrically isolates them from the surrounding metal parts. A thin strip of metal, typified by lead strip 24, extends from each of the eyelets 12, 14 and 16, and provides for electrical connection to the cathodes.

Figure 2:
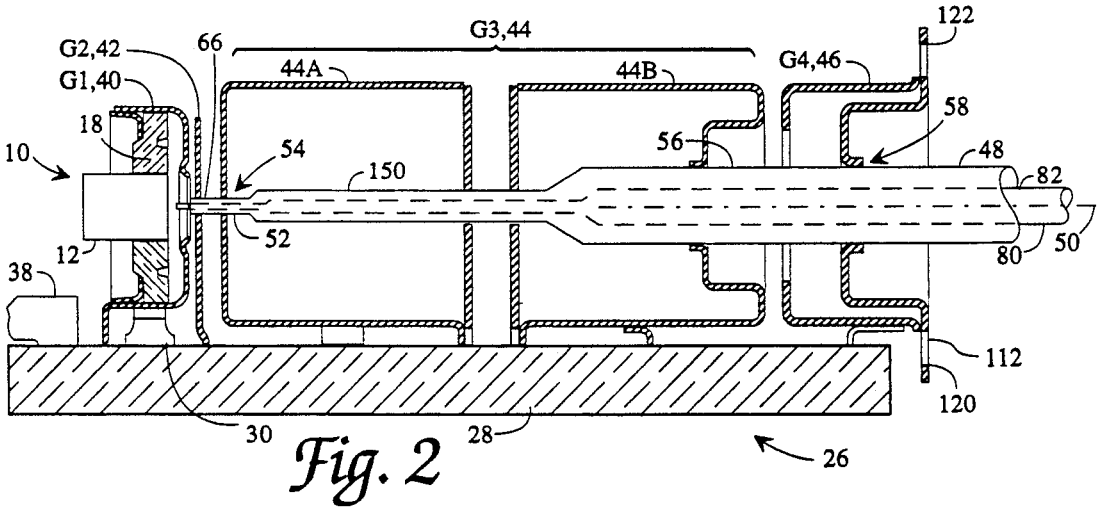
FIG. 2 is a cross-sectional view of an in-process electron gun, or "beaded assembly", seen longitudinally along one-beam channel, with a section of the probe used for K-G1 spacing according to the invention shown inserted in the beam channel.

FIG. 2 is a partial cross-sectional depiction of a beaded assembly 26 with a spacing probe 48 in place. The gun grids, or electrodes, each of which is apertured for passage of the electron beams, are spaced and supported by two glass beads on opposite sides of the gun, one of which—bead 28—is depicted. Due to inherent inaccuracies in the spacing process, the overall lengths, or "stack height", in a production run of beaded assemblies may vary by as much as 0.011 inch.

Depicted in progression from left to right, the components of the beaded assembly 26 include the cathode mounting assembly 10, a G1 electrode 40, and a G2 electrode 42. The G3 electrode 44 that follows consists of a lower grid assembly 44A and an upper grid assembly 44B. The designations "lower" and "upper" indicate the location of the gun components with reference to the cathode being lower than the screen.

The final electrode is the G4 electrode 46. The electrons generated by each cathode are formed into a discrete beam by the G1 and G2 electrodes, sometimes referred to as the beam forming region, and the beams are focused and accelerated by the $G_3$ and G4 electrodes.

Because the spacing of the gun components in the beam forming region is critical to overall CRT performance, and repeatability of such spacings from gun to gun are essential to efficient manufacturing of CRTs, the cathode to first electrode grid, or K-G1, spacing is very important.

According to the present invention, the apparatus, its set-up and use, as further discussed below, should include the following steps:

1) set the measuring probe tip to the proper K-G1 spacing, 2) set the probe tip reference collar to the proper distance/spring tension for insertion into the beaded assembly, 3) set the measuring scale to zero, 4) place a cathode in a retainer, 5) place a beaded assembly over the probe,
6) contact the cathode to the probe, and
7) fix the cathode in relation to G1.

To accomplish this, the apparatus of the present invention includes a touch probe having an outer shaft for insertion through the beaded assembly, and an inner shaft for touching the cathode, the inner shaft being connected to metrology means, such as a LVDT, or linear velocity differential transformer, for quantifying inner shaft movement. Further, an operator interface for displaying the quantified movement of the inner shaft and means for placing the cathode in contact with the inner shaft are supplied.

The Cathode-Insertion Machine

FIG. 4 depicts details of the probe section of cathode-insertion machine 94. The cathode-insertion machine 94 according to the invention comprises a novel adaptation of the "Universal Cathode Welder" manufactured by Harjes Tool Company of Chicago, Ill.

The cathode-insertion machine 94 includes a probe housing 97 topped with a base plate 98 for receiving the beaded assembly 26. The probe housing 97 is impelled by a pneumatic cylinder (not shown) to move up and down on slide rod(s) 100 for ease of loading the beaded assembly 26. The probe housing 97 has an inner section 102 which carries the probe 48. By movement of the inner section 102, the location of the probe 48 can be adjusted with respect to the beaded assembly 26, as will be described.

Description of the K-G1 Measuring Probe

As seen in FIG. 2, probe 48 according to the invention for measuring and establishing the K-G1 spacing is shown as inserted into the beaded assembly 26. The probe 48 is concentric with the center line 50 which is the path of, e.g., the "red" beam. Registration is provided by an increase in the diameter of the probe 48 in two lands 52, 56 starting from the lower end of the beaded assembly 26. The diameter of the probe land 52 is selected so as to slide smoothly with near-zero tolerance through the aperture 54 of the lower grid assembly 44A of the G3 electrode 44. Similarly, the diameter of land 56 of the probe 48 is selected to slide smoothly through aperture 58 of the G4 electrode 46.

Figure 3:
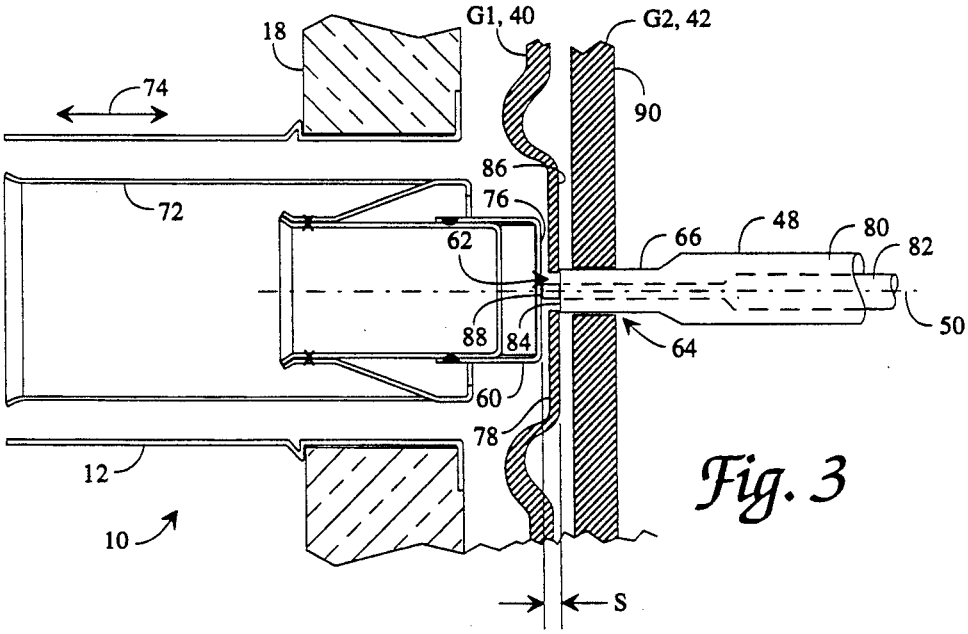
FIG. 3 is a detail view of FIG. 2 showing the cathode mounting assembly with a dispenser cathode housing installed therein, and the probe in place for gaging the K-G1 spacing.

FIG. 3 is an enlarged detail view of the probe 48 in the area of its intersection with a dispenser cathode 60, the aperture 62 of the G1 electrode 40, and the aperture 64 of the G2 electrode 42. The diameter of the narrowest probe land 66 is sized to fit through the aperture 64 of the G2 electrode 42.

The probe 48 comprises in part an outer shaft 80 and an inner shaft 82 concentric with, and in movable relationship to, the outer shaft 80. The outer shaft 80 is constructed and arranged according to the dimensions of the type of gun, or beaded assembly, which is being fixed with cathodes. The outer shaft 80 has, at one end thereof, a reference collar or shoulder 84 for contacting a registration surface 86 of the G1 electrode 40, noted as being the upper surface of the G1 electrode 40. The probe tip 88, which is the tip of the inner shaft 82, passes through the G1 aperture 62 and contacts the face 76 of cathode 60.

The measurement of the K-G1 spacing is made by gaging the distance between the face 76 the cathode 60 and the probe tip reference collar 84 resting on the G1 registration surface 86, and subtracting the thickness dimension of the G1 electrode 40 which is held to close tolerance in the electrode manufacturing process.

K-G1 spacing could as well be established gaging the distance between the face 76 of the cathode 60 and side 90 of the G2 electrode 42. If this type of spacing is desired, termed a "K-G2" spacing, the outer shaft 80 of the probe 48 would be shorter, i.e., formed so that its shoulder contacts the upper side 90 of the G2 electrode 42. Shoulder 84 would be eliminated.

The diameter of the aperture 62 of the G1 electrode 40 of the beaded assembly 26 may be 0.014 inch, by way of example. An aperture of this relatively small diameter necessarily restricts the number of electrons that can pass through it. This restriction is compensated for by the use of a dispenser cathode which, as noted, can be heated to a higher temperature than an oxide cathode, and hence will emit a greater number of electrons able to pass through the smaller aperture.

Description of the LVDT

As seen in FIG. 4, the probe 48 extends through the inner section 102 of the probe housing 97 as indicated, with the inner shaft 82 connected to the tip 126 of a linear velocity differential transformer or LVDT 128. The electrical output of the LVDT 128 is connected to the K-G1 spacing indicator 95 (FIG. 6) by an electrical conductor 196.

The LVDT 128 is an electromechanical transducer that produces an electrical output proportional to the displacement of a rod-like movable metallic core 130 which is mechanically linked to the tip 126. The movement of the core 130 is the result of pressure on the tip 126 by the inner shaft 82 of the probe 48.

The output of the LVDT is a differential voltage which varies linearly with the position of the core 130.

The differential voltage, and hence a variation in K-G1 spacing, is detected and displaying by the K-G1 spacing indicator 95, as described in the section "Setting Up the K-G1 Spacing Indicator 95."

The LVDT embodied in the movement-detection device 128 is preferably an SPI PRETEC (R) Measuring Probe, Model No. 2922, supplied by Reynolds Machine & Tool Corporation, Melrose Park, Ill. The Model 2922 Measuring Probe is fitted to provide for vacuum lift of its tip 126 (a capability not utilized in this application).

Setting The Probe Tip to The Desired K-G1 Spacing

Referring again to FIG. 3, it is necessary to set the probe tip 88 extension from the outer shaft shoulder 84 to the exact K-G1 - spacing desired; for example 0.008 inch. The probe tip 88 is pre-set to the desired K-G1 spacing with the help of a tool called a "set master," depicted in FIG. 8. The set master 144 consists of a body 146 having a bore hole 148 therein for receiving the probe 48. The internal diameter of the bore hole 148 is sized to conform to the outside diameters of the land 150 and the land 52 (see FIG. 2) of the outer shaft 80. The set master 144 is held in place on the probe 48 by a set screw (not indicated). A shim plate 152 and a stop pin 154 extend from the body 146.

Figure 9:
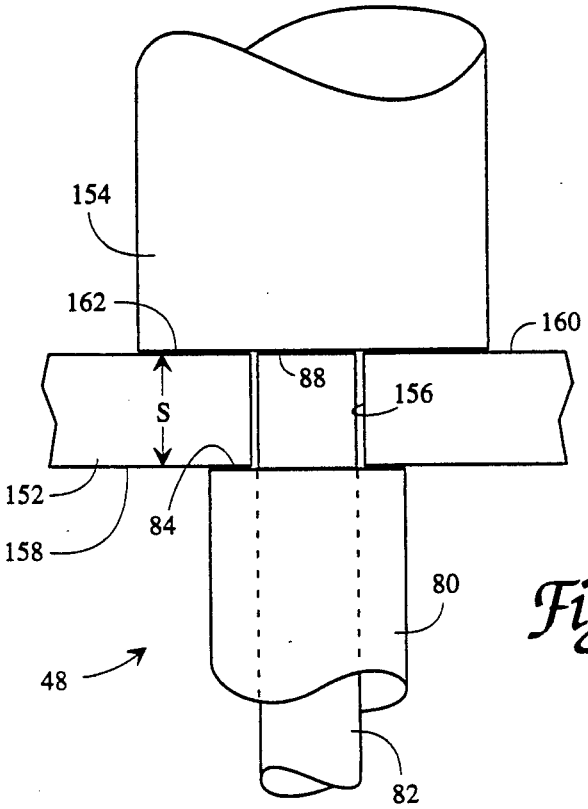
FIG. 9 is an enlarged view in elevation of the intersection of the components of the device depicted in FIG. 8.

FIG. 9 is a detail view of the intersection of the components that enter the set master body 146. The inner shaft 82 passes through a hole 156 in the shim plate 152. The shoulder 84 on the outer shaft 80 is in abutting contact with the bottom surface 158 of the shim plate 152. The probe tip 88 is prevented from moving beyond the top surface 160 of the shim plate 152 by the bottom surface 162 of the stop pin 154, which is in abutting contact with the top surface 160 of the shim plate 152.

The thickness of the shim plate 152 is "S", the sum of the K-G1 spacing and the thickness dimension of the G1 electrode 40. For example, if the K-G1 spacing is to be 0.008 inch, and the thickness of the G1 electrode 40 is 0.003 inch, the shim plate thickness will be 0.008+0.003=0.011 inch.

If the K-to-electrode spacing is to be measured from the G2 electrode 42, the thickness of the shim plate will be the sum of the K-G1 spacing desired, the thicknesses of the G1 and G2 electrodes, and the space between G1 and G2. For example, if the K-G1 spacing is to be 0.008 inch, the thickness of the G1 and G2 electrodes is 0.003 inch and 0.006 inch, respectively, and the spacing between the G1 and the G2 electrodes is 0.010 inch, the shim plate thickness will be 0.008+0.003+0.006+0.010=0.027 inch.

The thickness of the shim plates must be accurate to within 0.0001 inch.

The proper extension of the probe tip 88 is set by adjusting the position of the LVDT 128 that is enclosed in the inner section 102. First, the inner section 102 is adjusted so that the shoulder 84 of the outer shaft 80 is at a height to be in firm contact with the registration surface 86 of the G1 electrode 40, as described in the next section. Next, the set master 144 must be installed as described in the foregoing.

As seen in FIG. 4, the LVDT 128 is normally held firmly within the inner section 102 by three set screws 164, 166 and 167 which apply pressure on a split sleeve 168 against the body 170 of the LVDT 128.

Figure 8:
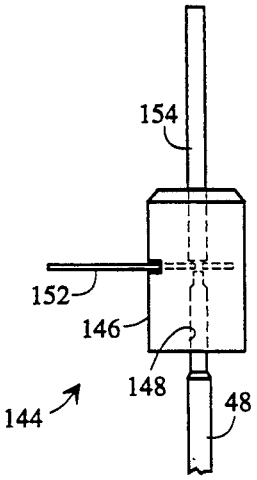
FIG. 8 is view in elevation of a device used for setting the inner shaft probe extension shown by FIG. 3 to the desired K-G1 spacing, with the components within the device depicted with dash lines.

The probe tip 88 is extended to the proper K-G1 spacing by loosening the set screws 164, 166 and 167, and sliding the body 170 of the LVDT 128 to the point where the probe tip 88 makes contact with the stop pin 154 of the set master 144 (FIG. 8). When contact has been made, the set screws 164, 166 and 167 are tightened, clamping the split sleeve 168 on the LVDT body 170. The set screws must be tightened with care as any undue pressure on the body 170 of the LVDT 128 will cause the LVDT 128 to produce an erroneous electrical signal.

Locating the Probe With Respect to the Beaded Assembly Height

Referring to FIG. 4, in preparation for measuring and setting the K-G1 spacing, the inner section 102 carrying the LVDT 128 and the probe 48 must be established in proper relationship with the beaded assembly 26. The shoulder 84 of the outer shaft 80 of the probe 48 (FIG. 3) must be in contact with the registration surface 86 of the G1 electrode 40. Therefore, the outer shaft 80 is constructed and arranged to be slightly longer than the beaded assembly stack height, or G4 to G1 distance. Contact is insured by biassing the inner section 102 of the probe housing 97 toward the beaded assembly 26. This bias, indicated by arrow 140, is provided by a spring 141, the tension of which is adjusted by a screw means 142. The adjustment screw 142 has threads of very fine pitch, providing for adjustments with a tolerance of, e.g., 0.0001 inch. The thrust of the spring 141 is adjusted by the screw means 142 to exert a force slightly greater than that required to offset the weight of the inner section 102 but less than an amount which would damage the G1 electrode 40. As a result, the outer shaft shoulder 84 of the probe 48 will exert a slight pressure on the G1 registration surface 86.

When a beaded assembly 26 is placed over the probe 48, the shoulder 84 of the outer shaft 80 makes contact with the registration surface 86 of the G1 electrode 40. As the beaded assembly face 112 is forced into contact with the base plate surface 114 by the locking cams 116 and 118, the inner section 102 moves downwardly against the force of the spring 140. Thus the inner section 102 compensates for variations in the heights of the beaded assemblies.

Setting Up the K-G1 Spacing Indicator 95

When the probe tip 88 has been set at the desired K-G1 spacing, the K-G1 - spacing indicator 95 (FIG. 7) is set to zero.

By virtue of a "zero positioning" system, as soon as the probe tip 88 touches the face 76 of the cathode 60, the contact will be indicated on the K-G1 -spacing indicator 95. Any deviation from zero is indicative of a deviation from the desired K-G1 spacing.

The Reynolds Analog Column Comparator that is used as the K-G1 spacing indicator 95 (FIG. 7) is about 13 inches high. The indicator column 172 consists of a first stack 174 and a second stack 176 of indicator diodes 178 which emit orange light when illuminated. The second stack 176 of diodes, and associated incremental indicators, are utilized in this application. The second stack 176 of indicator diodes 178 shown as being lit to the zero level to indicate the "zero" position of the K-G1 spacing indicator 95. The K-G1 spacing indicator 95 is set to display a range of plus 0.003 inch and minus 0.003 inch. One increment of the scale of the second stack 176 indicates a 0.00005 inch movement of the probe tip 88, denoted by arrow 180. Two increments of the scale indicate a 0.0001 inch movement of the probe tip 88, denoted by arrow 182.

The K-G1 spacing indicator 95 is set to zero by means of a zero-adjustment control 177 located on the lower front side of the K-G1 spacing indicator 95.

The K-G1 spacing indicator 95 is preferably the Model 2801 Analog Column Comparator also supplied by Reynolds. The Model 2801 Comparator provides for measurement in either metric or inch units; the measurements described are in inches. The combination of the LVDT 128 and the K-G-1spacing indicator 95 provides for measurement of K-G1 spacing in the beaded assembly 26 with an accuracy of 0.00005 inches.

Installation of the Beaded Assembly 26

As seen in FIG. 5, in preparation for gaging K-G1 spacing, the beaded assembly 26 is manually lowered over the probe 48 which extends from the probe housing base plate 98, as indicated. The red gun G1 aperture of the beaded assembly 26, whose center line is indicated by reference number 50, is shown in position for K-G1 spacing. The face 112 (FIG. 2) of the G4 electrode 46 rests squarely on the surface 114 of the base plate 98. The beaded assembly 26 is locked firmly down on the surface 114 of the base plate 98 by two locking cams 116 and 118, which are rotated manually to engage flanges 120 and 122 of the G4 electrode 46.

The K-G1 spacing of each respective beam path in the beaded assembly is accomplished in succession. For example, the K-G1 spacing of the red beam channel may be established first, followed by the blue and green beam channels.

Description of the the Cathode Retainer 105

Referring to FIG. 3, the cathode 60 is installed in the eyelet 12 of the cathode mounting assembly 10. The cathode 60 is enclosed in a cathode housing 72 that is mounted concentrically with the eyelet 12. The diameter of the cathode 60 may be 0.100 inch, and the diameter of the eyelet 12 may be 0.130 inch, by way of example. Consequently, the cathode housing 72 can be slid longitudinally in the eyelet 12 with the result that the face 76 of the cathode 60 can be moved away from, and toward, the lower side 78 of the G1 electrode 40. It is by this movement of the cathode 60 that the K1-G1 spacing is adjusted.

The letter "S" is an arbitrary symbol that denotes the space between the face 76 of cathode 60 and the cathode facing side 78 of the G1 electrode 40 that is in opposed relationship thereto. In short, S indicates the K-G1 spacing. This is a critical "beam forming" dimension.

Referring to FIG. 5, the top section 104 of the machine 94 includes a cathode retainer 105, shown in greater detail in FIG. 6. The cathode retainer 105 projects downwardly from top section 104.

The cathode retainer 105 holds the cathode housing 72 in a position such that, when the probe housing 97 is raised by the pneumatic cylinder (not shown) the eyelet 12 will slide over the cathode housing 72. The cathode housing 72 is retained at the tip 106 of the cathode retainer 105, by means of a slight vacuum introduced at the tip 106 through a conduit 107, indicated by the dash lines, that runs through the cathode retainer 105.

The cathode retainer 105, when centered in the cathode housing 72, also acts as the negative electrode for spot-welding the eyelet 12 to the cathode housing 72, as described below.

The cathode retainer 105 is caused to move in first and second directions 108 by screw means 109 (FIG. 5) located in the top section 104 of the cathode insertion machine 94. The screw means 109 is rotated manually by means of a lever 110 that extends from the screw means 109. The rotation of screw means 109 moves the cathode face 76 into contact with, or away from, the probe tip 88 (FIG. 3). The screw means 109 has very fine threads. Turning of the lever 110 one-half turn results in a vertical excursion of the cathode retainer 105, and consequently the cathode 60, of 0.010 inch.

Fastening the Cathode 60 to the Eyelet 12

Figure 10:
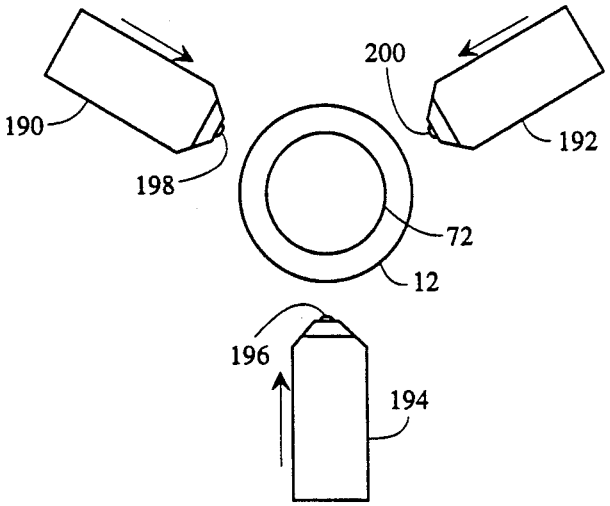
FIG. 10 is a detail plan view of the components used in the process of making permanent a desired K-G1 spacing.
Figure 11:
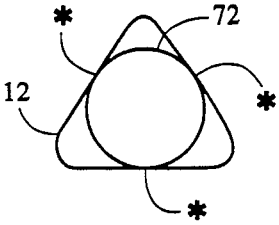
FIG. 11 is view similar to FIG. 10 showing the effect on the components of the process shown by FIG. 10.

FIG. 10 is a diagrammatic depiction of the process of crimping and welding the cathode casing 72 to the eyelet 12. The cathode 60 is retained on the cathode retainer 105 as depicted in FIGS. 5 and 6. By the raising of the beaded assembly 26 on the base plate 98, the cathode housing 72 enters the eyelet 12. The relative positions of the cathode 60 and the eyelet 12 before the crimping-welding process are indicated in FIG. 3. Three crimping-welding heads 190, 192 and 194 are located in the top section 104 of the cathode insertion machine 94, and are impelled by cams rotated by an air cylinder (not shown) to exert inward pressure on the eyelet 12 as indicated by the associated arrows. The final configuration of the eyelet 12 upon crimping is indicated in FIG. 11.

The crimping-welding heads 190, 192 and 194 also provide for welding the eyelet 12 to the cathode housing 72. The cathode retainer 105 which holds the cathode 60 within the eyelet 12 is at ground potential, and the crimping-welding heads 190, 192 and 94, when activated, are electrically positive at a spot-welding potential.

When the walls of the eyelet 12 come into contact with the cathode housing 72 under the pressure of the crimping-welding heads 190, 192 and 194, the welding tips 196, 198 and 200 of the crimping-welding heads 190, 192 and 194 are energized, spot-welding welding the eyelet 12 and the cathode housing 72 together in the locations indicated by the welding symbols (*).

While a particular embodiment of the invention has been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

What is claimed:

1. An apparatus for spacing a dispenser cathode in a cathode eyelet of a beaded assembly of a CRT electron gun at a fixed distance from an adjacent apertured grid electrode in the beaded assembly comprising:

a) means for holding the beaded assembly over a probe;

b) the probe constructed and arranged to pass through the apertures of the beaded assembly, the probe including:

1) an outer shaft having a shoulder for contacting a registration surface of the adjacent electrode, and 2) an inner shaft movable within and extensible from the outer shaft and having a tip sized to pass through the aperture of the adjacent electrode;

c) means for extending the inner shaft a predetermined distance from the outer shaft shoulder;

d) metrology means for detecting and quantifying movement of the inner shaft; and e) means for adjustably placing the cathode in the cathode eyelet and bringing the cathode into contact with the inner shaft tip, whereby the distance of the cathode from the adjacent electrode may be determined in real time and adjusted to the proper distance.

2. The apparatus of claim 1 wherein the means for holding the beaded assembly further includes a reference base through which the probe passes, and to which the beaded assembly is fastenable.

3. The apparatus of claim 1 wherein the diameter of the inner shaft is less than 0.016 inches.

4. The apparatus of claim 1 further comprising means for extending the outer shaft shoulder a fixed distance from the reference base.

5. The apparatus of claim 4 wherein the means for extending the outer shaft shoulder is compressible to accommodate variations in the dimensions of the beaded assembly length.

6. The apparatus of claim 1 further including operator interface means for indicating the quantity of movement of the inner shaft when contacted by the cathode, the operator interface means being operatively connected to the metrology means.

7. The apparatus of claim 6 wherein the metrology means and the operator interface means are constructed and arranged to provide a constant read-out of the inner shaft quantity of movement.

8. An apparatus for spacing a CRT electron gun in the beaded assembly of a dispenser cathode relative to an apertured grid electrode comprising:

a) a probe including:

1) an outer shaft having a shoulder for contacting a registration surface on the grid electrode;

2) an inner shaft concentric with, and in movable relationship to, the outer shaft;

3) the inner shaft further including means for extending said inner shaft a predetermined distance beyond said outer shaft shoulder;

b) metrology means for detecting and quantifying movement of the inner shaft in relation to the outer shaft;

c) operator interface means for displaying said quantified movement of said inner shaft operatively connected to said metrology means; and d) means for placing the cathode in contact with said inner shaft tip.

9. The apparatus of claim 8 further comprising: means for fixing the cathode at a permanent position in the beaded assembly.

10. The apparatus according to claim 8 wherein the inner shaft has a diameter of less than 0.016 inches.

11. The apparatus of claim 8 wherein the metrology means is physically connected to the inner shaft.

12. The apparatus of claim 11 wherein the metrology means is further physically connected to the outer shaft.

13. The apparatus of claim 12 wherein the assembly comprising the physically connected metrology means, inner shaft, and outer shaft is spring loaded to accommodate dimensional tolerances among beaded assemblies.

14. An apparatus for spacing and fixing a dispenser cathode in a cathode eyelet of a beaded assembly of a CRT electron gun at a fixed distance from an adjacent apertured grid electrode in the beaded assembly, comprising:

a) a reference base;

b) means for holding the beaded assembly to the reference base;

c) probe means passable through the beaded assembly and the reference base, the probe including:

1) an outer shaft having a shoulder for contacting a registration surface of the adjacent electrode;

2) an inner shaft movable within, and extensible from, the outer shaft and having a tip sized to pass through the aperture of the adjacent electrode;

d) means for extending the outer shaft shoulder a fixed distance from the reference base;

e) means for extending the inner shaft a fixed distance from the outer shaft shoulder;

f) metrology means mechanically connected to the inner shaft for detecting and quantifying movement of the inner shaft;

g) operator interface means for indicating the movement of the inner shaft, the operator interface means being operatively connected to the metrology means;

h) cathode placement means for adjustably placing the cathode in the cathode eyelet and bringing the cathode into contact with the inner shaft tip; and i) cathode fixing means for fixing the cathode within the cathode eyelet.

15. The apparatus according to claim 14 wherein the metrology means is a linear velocity differential transformer (LVDT).

16. The apparatus according to claim 14 wherein the diameter of the inner shaft is less than 0.016 inches.

17. The apparatus according to claim 14 wherein the metrology means is accurate to $\pm 0.00005$ inches.

18. The apparatus of claim 14 wherein the metrology means and operator interface means are constructed and arranged to provide a constant read-out of the quantity of inner shaft movement as the cathode is adjustably placed in contact therewith.

19. The apparatus according to claim 14 wherein the means for extending the outer shaft is compressible to accommodate variations in the dimensions of the beaded assembly.

20. The apparatus according to claim 19 wherein the means for extending the outer shaft includes a spring and means for adjusting tension on the spring.

* * * * *